US007115823B1

(12) United States Patent
Anaya-Burgos

(10) Patent No.: US 7,115,823 B1
(45) Date of Patent: Oct. 3, 2006

(54) ELECTRICAL TRANSFER SWITCH

(76) Inventor: Alberto Anaya-Burgos, P.O. Box 820, Arroyo, PR (US) 00714

( * ) Notice: Subject to any disclaimer, the term of this patent is extended or adjusted under 35 U.S.C. 154(b) by 0 days.

(21) Appl. No.: 11/208,394

(22) Filed: Aug. 19, 2005

(51) Int. Cl.
*H01H 9/28* (2006.01)

(52) U.S. Cl. ..... 200/43.01; 200/329

(58) Field of Classification Search ..... 200/43
See application file for complete search history.

(56) References Cited

U.S. PATENT DOCUMENTS 4,295,053 A * 10/1981 Kovatch et al. ..... 307/64
5,422,453 A * 6/1995 Smith et al. ..... 200/329
6,031,193 A * 2/2000 Flegel ..... 200/50.33
6,861,596 B1 * 3/2005 Schnackenberg ..... 200/43.01

* cited by examiner

*Primary Examiner*—Elvin Enad
*Assistant Examiner*—Lheiren Mae Anglo
(74) *Attorney, Agent, or Firm*—Hoglund & Pamias, PSC; Heath W. Hoglund

(57) ABSTRACT

A switch operates between a first and a second position which selectively connects a load to a first and a second power supply. The connections are made by sliding one or more rods along their axis. The ends of the rods fit within channels to form electrical contact with the first and second power supply.

10 Claims, 9 Drawing Sheets

ELECTRICAL TRANSFER SWITCH

FIELD OF THE INVENTION

The invention relates generally to electrical switches, and more specifically to switches used to switch between a primary power source and an auxiliary power source.

BACKGROUND OF THE INVENTION

The reliable supply of electricity is important for businesses and homes. Indeed, virtually every business and home relies upon the continuous supply of electricity to refrigerate food, to operate heating and cooling systems and many other appliances.

In some applications, the uninterrupted supply of electricity is absolutely critical. For example, computer systems generally require a virtually perfect power supply. Even a momentary glitch can disrupt their operation. Consequently, where the supply of electricity is unreliable, back-up power sources commonly referred to uninterrupted power supplies are used. These usually include a power detection and filtering circuit. If the main power fails, the back-up power source immediately detects the failure and switches to a battery or other back-up source. In more sophisticated systems, the back-up power source will switch to an alternative power supply such as a generator if the main power remains off line.

Although these types of systems are effective even for the most demanding of applications, they are also expensive. The circuitry required to monitor the main power supply and associated battery back up are relatively complex. Moreover, this type of uninterrupted power supply is not necessary for many applications. For example, many businesses or homes can tolerate a short interruption in their power supply. Interruptions of only a few minutes have little effect on heating or cooling systems. Critical applications such as a computer can depend upon a local back-up power supply. If the main power supply continues to fail, a local generator can be started to provide back-up power.

The installation of a back-up generator requires that it is connected into the loading circuits in a manner that does not interfere with the normal delivery of power from a local utility company. The back-up generator must be disconnected when the local utility company provides power to prevent large flows of electricity between the two sources. In most conventional home or business settings, the internal wiring is connected directly to the local utility company through a power meter and breaker switches. The power meter is used to monitor usage for billing purposes. The breaker switches are used to prevent excessive flow of current through any loading circuit.

The addition of an auxiliary power supply requires a switch which is capable of handling the current drawn by an entire home or business. Especially in larger business applications, the total current drawn from a back-up power supply or from the power grid can be substantial. The switch must be able to handle large currents without heating. In order to do so, electrical transfer switches are typically very large. In order to avoid heating at the switch contacts, these are very substantial in size. A transfer switch suitable for high-current applications which is relatively small is desired.

SUMMARY OF THE INVENTION

According to one aspect of the invention, a switch is especially suitable for connecting a load to one of two power supplies. The switch has a first and second set of connections. The first set of connections is for connecting with a first power supply. The second set of connections is for connecting with a second power supply. The switch also has a first and a second set of contacts. Each of the contacts has a first and a second connection block. The first connection block defined a first surface channel extending from a first end to a second end of the first connection block. The second connection block defines a second surface channel extending from a first end to a second end of the second connection block. The first surface channel and the second surface channel are aligned to define an interior channel open at the first and second ends of the first and second connection blocks. The first set of contacts is electrically coupled with the first set of connections and the second set of contacts is electrically coupled with the second set of connections. The switch also includes a third set of connections for connecting to a load and a set of plungers. The set of plungers are electrically coupled with the third set of connections. The plungers have a first end and a second end. The first ends of the plungers are configured to fit within and make electrical contact with the interior channels defined by the first set of contacts. The second ends of the plungers are configured to fit within and make electrical contact with the interior channels defined by the second set of contacts.

According to further aspects of the invention, the first, second and third set of connections each comprise an interior channel for receiving an end of a wire and a screw for making physical and electrical connection with the end of the wire. The switch also includes insulated board. The first, second and third set of connections are mounted on the insulated board. The first set of connections are positioned in a first row proximate a first end of the insulated board. The second set of connections are positioned in a second row proximate a second end of the insulated board. The third set of connections are positioned in a third row between the first end and the second end of the insulated board. The second and third rows are parallel to the first row. The first and third set of connections are evenly spaced. The even spacing of the third set of connections is offset from the even spacing of the first set of connections so that wires connecting with the third set of connections are offset from the first set of connections and pass through the even spacing of the first set of connections.

According to still further aspects of the invention, the insulated board has a top and a bottom side. The first, second and third set of contacts are positioned on the top side and the first, second and third set of connections are positioned on the bottom side. The first and the second surface channels each define a v-shaped groove so that the interior channel defined by the first and the second connection block has a square cross section. The set of plungers comprise a set of square rods positioned between the first and the second set of contacts to selectively engage the first and the second set of contacts. The set of square rods are oriented that their side walls lie at an approximately forty five degree angle with respect to the top side of the insulated board.

According to still further aspects of the invention, the switch further includes an insulated bar, a handle and a third set of contacts positioned between the first and the second set of contacts. The third set of contacts electrically connect the set of plungers with the third set of connections. Each of the third set of contacts has the same construction as the first and second set of contacts. The set of plungers pass through the insulated bar. The insulated bar has a top half and a bottom half between which the set of plungers are pinched to form a firm physical connection. The handle is operationally coupled with the insulated bar and configured to move the insulated bar from a first position to a second position. When the insulated bar is in the first position, the set of plungers engage the first set of connections. When the insulated bar is in the second position, the set of plungers engage the second set of connections.

According to another aspect of the invention, a three-phase switch is especially suitable for selecting between two power sources. The switch includes a housing, a first, second and third set of connections, a first and a second set of cylinders and a set of pistons. The first set of connections connect with a first power source. The first set of cylinders are electrically connected with the first set of connections. Each of the cylinders have an electrically conductive inner wall. The second set of connections connect with a second power source. The second set of cylinders electrically connected with the second set of connections. Each of the cylinders have an electrically conductive inner wall. The third set of connections connect with a load. The set of pistons electrically connect with the third set of connections. Each of the pistons has an electrically conductive outer wall that is sized to fit within the inner walls of the first set of cylinders and the inner walls of the second set of cylinders. The set of pistons are switchable between a first and a second position. The first position establishes an electrical connection between the first power source and the load by electrical contact between the electrically conductive outer walls of the set of pistons and the electrically conductive inner walls of the first set of cylinders. The second position establishes an electrical connection between the second power source and the load by electrical contact between the electrically conductive outer walls of the set of pistons and the electrically conductive inner walls of the second set of cylinders.

DETAILED DESCRIPTION OF THE INVENTION

An electrical power transfer switch has two positions. One position can be used to connect a load to a power source such as line power from a commercial power grid. Should the grid fail for any reason, the switch it moved to a second position. This disconnects the load from the power grid and connects the load to an auxiliary power source. The transfer from the grid to the auxiliary power is made by moving a rod along its axis. When fully extended in one direction, the rod engages a contact which is electrically connected with the power grid. And, when fully extended in the opposite direction, the rod engages another contact which is electrically connected to the auxiliary power supply. The rod engages contacts. These contacts define an interior channel that engages the rod. The interior channel has a profile that is complementary to that of the rod so that contact is made around the entire or a substantial portion of the contact.

Turning to FIG. 1, one preferred embodiment of a three-phase switch 100 is described. It includes three rods 102, 104 and 106. These are physically arranged in parallel. In the position shown, the rods 102, 104 and 106 engage contacts 108, 110 and 112, respectively. These are, for example, the contacts which are electrically coupled with a power grid. Along the middle of the rods 102, 104 and 106, they engage another set of contacts 114, 116 and 118, which are electrically connected with a load. Thus, rods 102, 104 and 106 connect the power grid to the load.

Figure 1A:
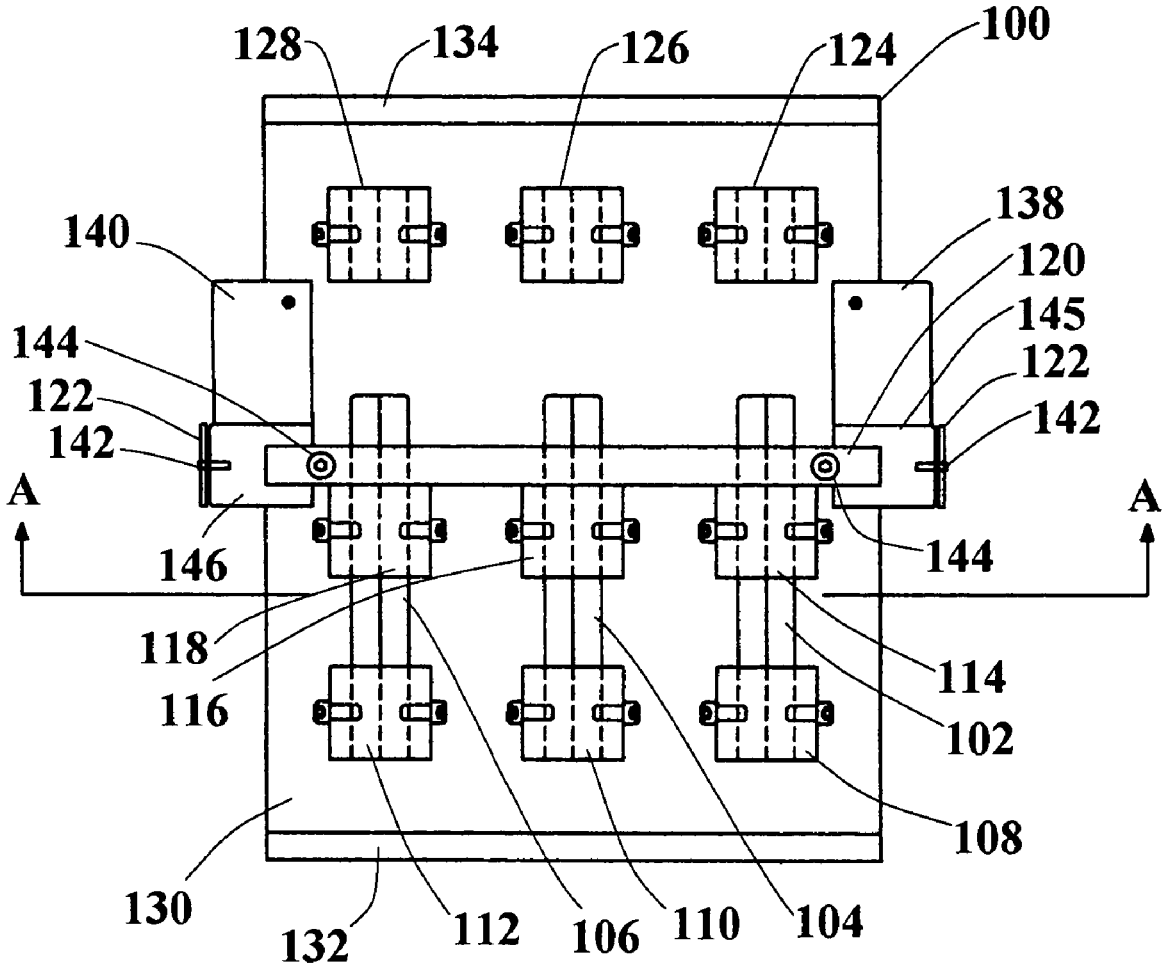
FIG. 1A is a bottom view of a three-phase switch shown in the normal position.
Figure 1B:
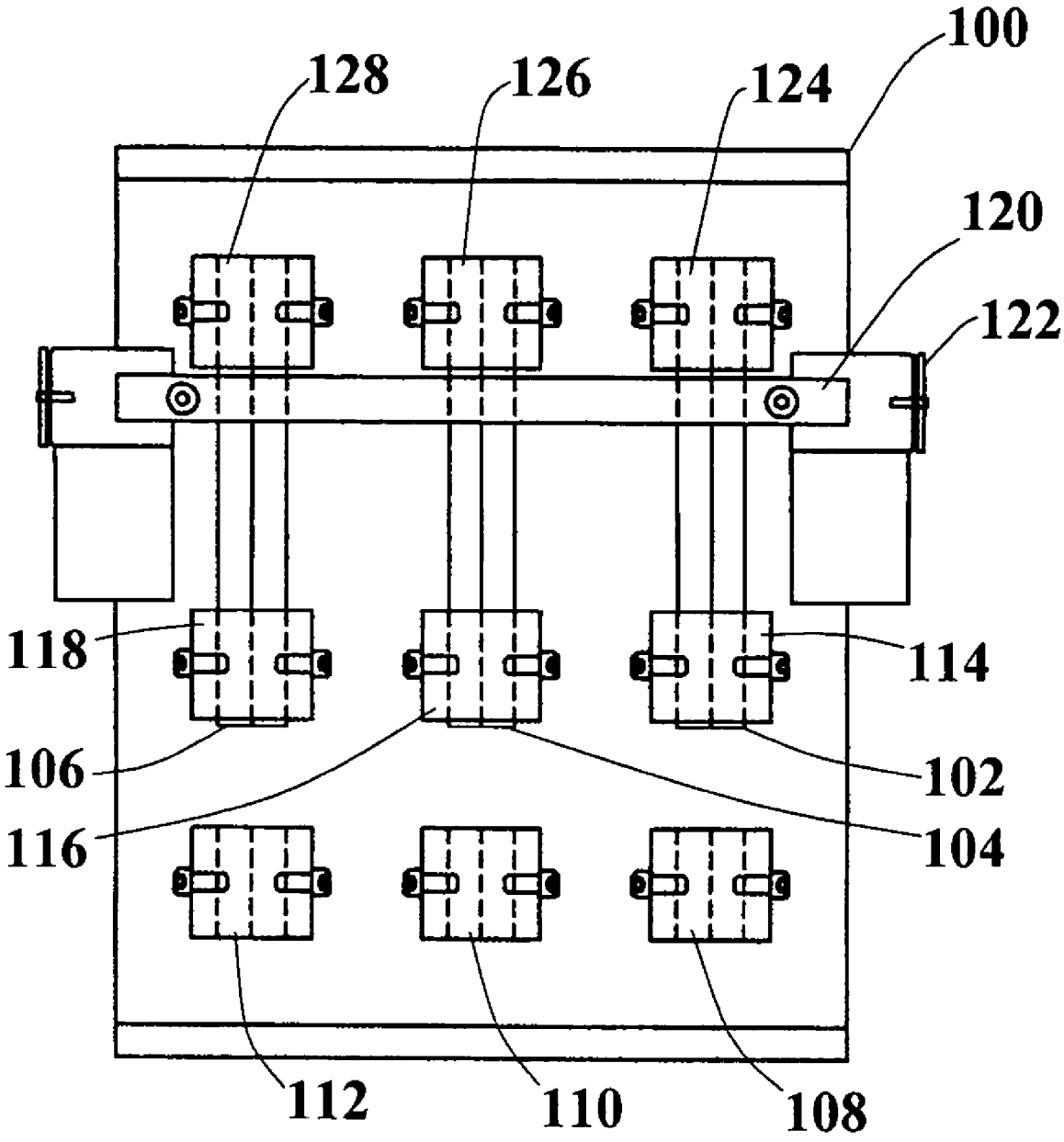
FIG. 1B is a bottom view of the three-phase switch of FIG. 1A shown in an auxiliary position.

The rods 102, 104 and 106 are held together by an insulating bar 120. The ends of bar 120 connect with the bottom end of a lever 122, which in turn connects with a handle. When an operator moves the handle, lever 122 is moved. Turning to FIG. 1B, the three-phase switch 100 is shown in the other position. Here, the handle has been moved to its auxiliary position. The bottom end of lever 122 is likewise moved to its other position along with bar 120. This, in turn moves the rods 102, 104 and 106 so that they are removed from contacts 108, 110 and 112 and so that the load is electrically disconnected from the electric grid. Instead, the opposite end of rods 102, 104 and 106 engage contacts 124, 126 and 128, which connects the auxiliary power with the load.

Returning to FIG. 1A, blocks 138 and 140 attach along the sides of insulated board 130. Levers 122 attach to blocks 138 and 140 through a pin 222 (shown in FIG. 2) which permits them to pivot. Another set of pins 142 pass through levers 122 and engage another set of blocks 145 and 146. These have a u-shape which define an interior channel. The bar 120 passed into the channel. Bolts 302 (shown in FIG. 3), connect the blocks 145 and 146 to the bar 120. Thus, levers 122 move blocks 145 and 146, which move bar 120, and which moves rods 102, 104 and 106.

Contacts 108, 110, 112, 114, 116, 118, 124, 126 and 128 are attached to insulated board 130. The insulated board 130 is rectangular. Each end of the insulated board joins an end board 132 and 134. Contacts 108, 114 and 124 are arranged along an axis aligned with rod 102. Contacts 110, 116 and 126 are arranged along an axis aligned with rod 104. And, contacts 112, 118 and 128 are arranged along an axis aligned with rod 106. Contacts 108, 110 and 112, which couple with a power grid are arranged along a row. Contacts 114, 116 and 118, which couple with a load, are arranged along a row. And, contacts 124, 126 and 128, which couple with auxiliary power, are arranged along a row. Each of these rows is perpendicular to the rods 102, 104 and 106.

Turning to FIG. 1B, the switch 100 has been moved to the auxiliary position. Rods 102, 104 and 106 have been slid along their axis by movement of lever 122 so that they no longer engage contacts 108, 110 and 112 but instead engage contacts 124, 126 and 128. Rods 102, 104 and 106 continue to engage contacts 114, 116 and 118. This establishes an electrical connection between an auxiliary power source and the load.

Figure 2:
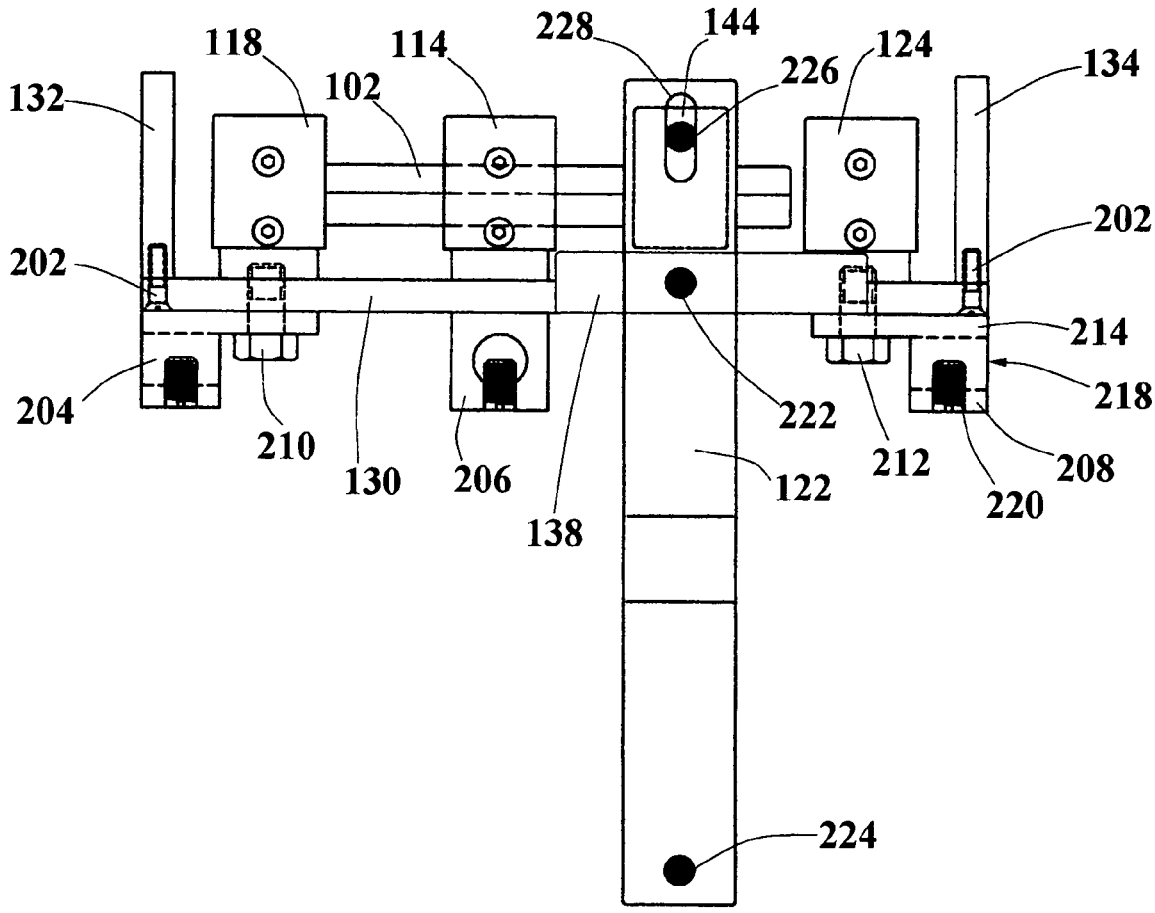
FIG. 2 is a side view of the three-phase switch of FIG. 1A.

Turning to FIG. 2, a side view of the three-phase switch 100 is shown. The insulated board 130 extends along the length of the switch 100. The insulated board 130 is shown in a horizontal orientation. It has a substantially uniform thickness. It joins end board 132 on the left and end board 134 on the right. The end boards 132 and 134 extend vertically up from the insulated board 130. Screws 202 extend through the insulated board 130 and into the end board 132 and 134. The end boards 132 and 134 are slightly higher than the contacts 108, 114 and 124 and the lever 122. A housing or cover can be added so that these elements are contained. Alternatively, the switch 100 can be mounted so that these elements are concealed.

Below the insulated board 130, an electrical connection is aligned with each of the contacts. As shown, connections 204, 206 and 208 are positioned below contacts 108, 114 and 124, respectively. Bolts 210 and 212 pass through contacts 204 and 208 and engage contacts 108 and 124. These bolts also establish an electrical path from the contacts 108 and 124 to the connections 204 and 208. A bolt also connects connection 206 to contact 114. It is not visible in this view due to the orientation of the connection 206.

Connection 208 is formed of a flat metal plate 214 which defines a hole for bolt 212. The plate 214 also connects with a metal cube 216 which defines an interior channel 218. A screw 220 passes through the metal cube 216. When an electric cable is placed inside channel 218, screw 220 is tightened to crimp the cable and form a firm physical and electrical connection. The other connections have the same configuration.

Lever 122, which moves rods 102, 104 and 106, moves about pivot 222. This pivot passes though lever 122 and engages block 138. A handle 224 connects at the bottom end of lever 122. Another pivot 226 attaches block 145 to the top end of handle 122. This pivot 226 passes through a slot 228 in lever 122. As the lever 122 is moved from one position to another, the pivot 226 slides along the slot 228 and translates the rotational movement of the lever 122 into lateral movement of block 145 and rod 102.

Figure 3:
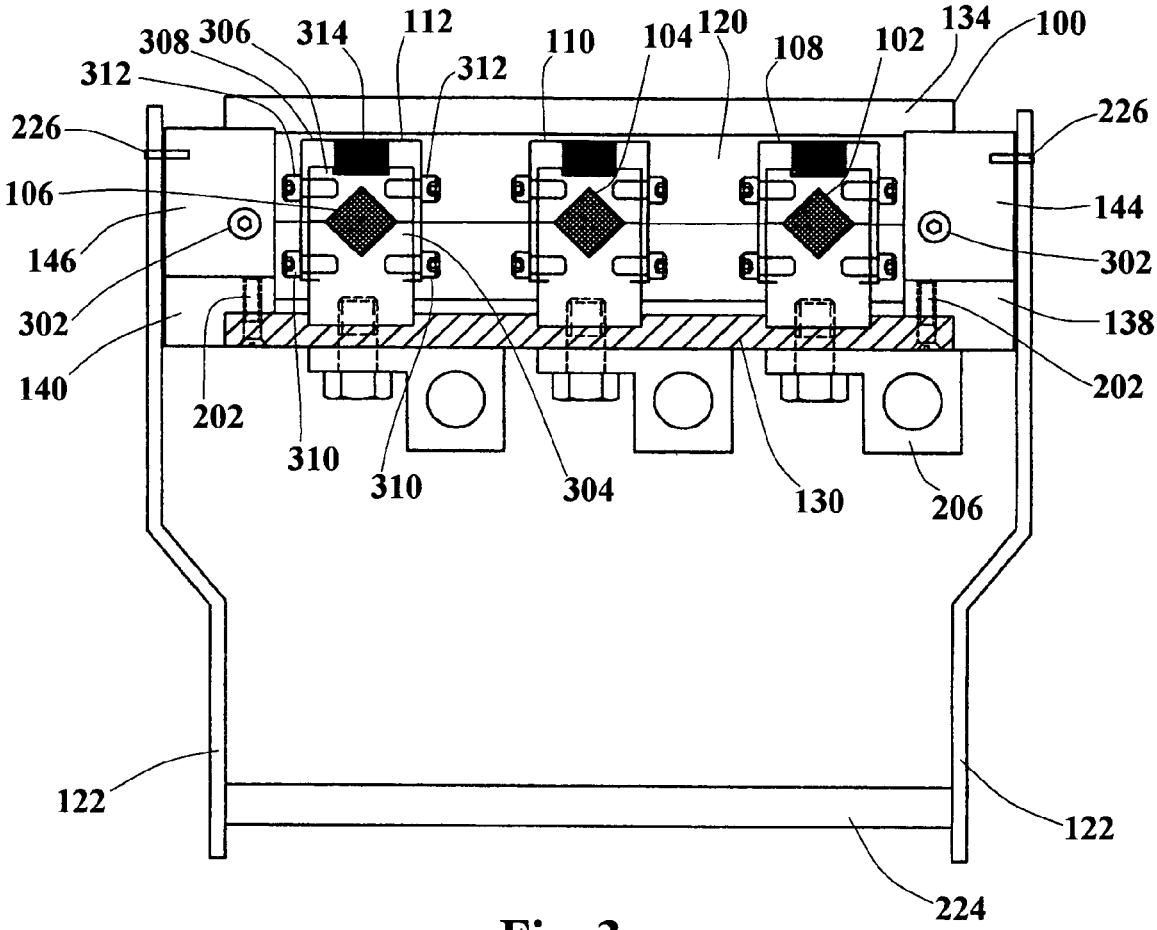
FIG. 3 is a cross-sectional view of the three-phase switch of FIG. 1A taken from the view shown as A—A in FIG. 1A.

Turning to FIG. 3, a cross-section of the three-phase switch 100 is shown. Levers 122 extend along each side of the three-phase switch 100. Levers 122 are connected to blocks 138 and 140 by a pivot 222 (shown in FIG. 2). Blocks 138 and 140 have an L-shape. The vertical leg of the L-shaped blocks 138 and 140 are sized to match the thickness of the board 130. The horizontal leg of the L-shaped blocks 138 and 140 extends along the top surface of board 130. Screws 300 pass through board 130 and engage blocks 138 and 140. This fixes blocks 138 and 140 on board 130.

Blocks 145 and 146 sit above blocks 138 and 140, respectively, but are not connected. When lever 122 is moved, blocks 145 and 146 move with respect to blocks 138 and 140. This movement is shown in FIGS. 1A and 1B. Blocks 145 and 146 connect with bar 120. Screws 302 pass through blocks 144 and 146 to fixedly attach the bar 120.

Bar 120 consists of a lower half and an upper half, each made of an insulating material. Each half is notched so that they fit around the rods 102, 104 and 106. Screws 144 (shown in FIG. 1A) connect the two halves and clamp the rods 102, 104 and 106 in place.

The individual contacts 108, 110 and 112 share a common construction along with the other contacts shown in FIG. 1A. Contact 106, for example, has a lower block 304 and an upper block 306. The lower block 304 defines a channel that matches the profile of rod 106. The upper block 306 defines a complementary channel that also matches the profile of rod 106. Rod 106 has a square cross section and is oriented so that its sides lie at a forty five degree angle with respect to the face of insulated board 130.

A u-shaped channel 308 passes around upper block 306 and extends midway down the lower block 304. At its bottom ends, the channel 308 includes a set of lips which extends inward and engages a channel along each side of the lower block 304. A set of screws 310 pass through the channel 308 and engage the lower block 304 so that channel 308 is rigidly attached to lower block 304. Another set of screws 312 pass through channel 308, above the set of screws 310. This set of screws engage the upper block 306. Channel 308 defines a hole through which screws 312 pass. The holes permit the body of screws 312 to move slightly up and down along with the upper block 306. Along the top side of upper block 306, a spring 314 is sandwiched between channel 308 and the top surface of upper block 306. This forces upper block 306 to presses down against rod 106, which also presses rod 106 down against lower block 304. This establishes a firm contact and electrical connection between rod 106 and both the upper block 306 and the lower block 304.

In an alternative embodiment, the bottom of the lower blocks 304 are dovetailed and the insulated board 130 is grooved to match so that the contacts 108, 110, 112, 114, 116, 118, 124, 126 and 128 are held vertically in place. In addition, an insulated plate is cut so that it matches the configuration of the contacts. The insulated plate is placed between the contacts to hold them horizontally in place. The insulated plate is positioned on top of and bonded to the insulated board 130.

In a further alternative embodiment, a lip is formed around the outer edge of the u-shaped channel 308 which holds the lower block 304 and upper block 306 in place. Use of the lip can eliminate the need for the screws (or pins) 310 and 312.

In a still further alternative embodiment, the handle assembly is eliminated in favor of a push-pull rod. The push-pull rod is positioned parallel to the axis of the rods 102, 104 and 106. The push-pull rod connects with bar 120 so that movement of the push-pull rod controls movement of the rods. The push-pull rod can be operated by an automatic, motorized system.

Figure 4A:
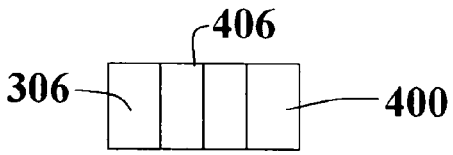
FIG. 4A is a bottom view of a top half of a contact.
Figure 4B:
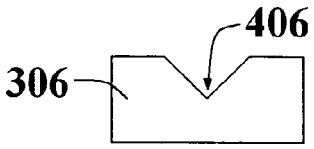
FIG. 4B is a side view of the top half of the contact shown in FIG. 4A.
Figure 4C:
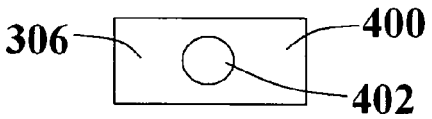
FIG. 4C is a top view of the top half of the contact shown in FIG. 4A.

Turning to FIGS. 4A–C, the upper block is further described. On its top face 400, a circular recess 402 is formed. This is used to hold the spring 314 in place. In its bottom face 404, the upper block defines a v-shaped channel 406. The v-shaped channel 406 extends from one end to the other of the upper block. Its profile matches the top half of the rods.

Figure 5A:
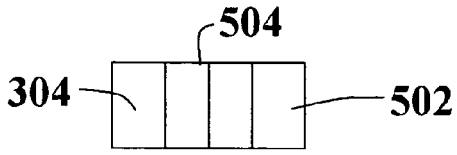
FIG. 5A is a top view of the bottom half of a contact.
Figure 5B:
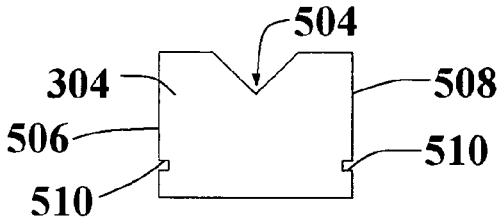
FIG. 5B is a side view of the bottom half of the contact shown in FIG. 5A.
Figure 5C:
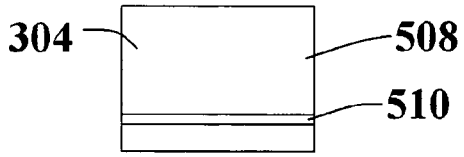
FIG. 5C is another side view of the bottom half of the contact shown in FIG. 5A.

Turning to FIGS. 5A–C, the lower block is further described. Its top face 502 defines a v-shaped channel 504. Its profile matches the bottom half of the rods. Along its side walls 506 and 508, a channel 510 is formed. This engages the lip of the unshaped channel 308 shown in FIG. 3.

Figure 6:
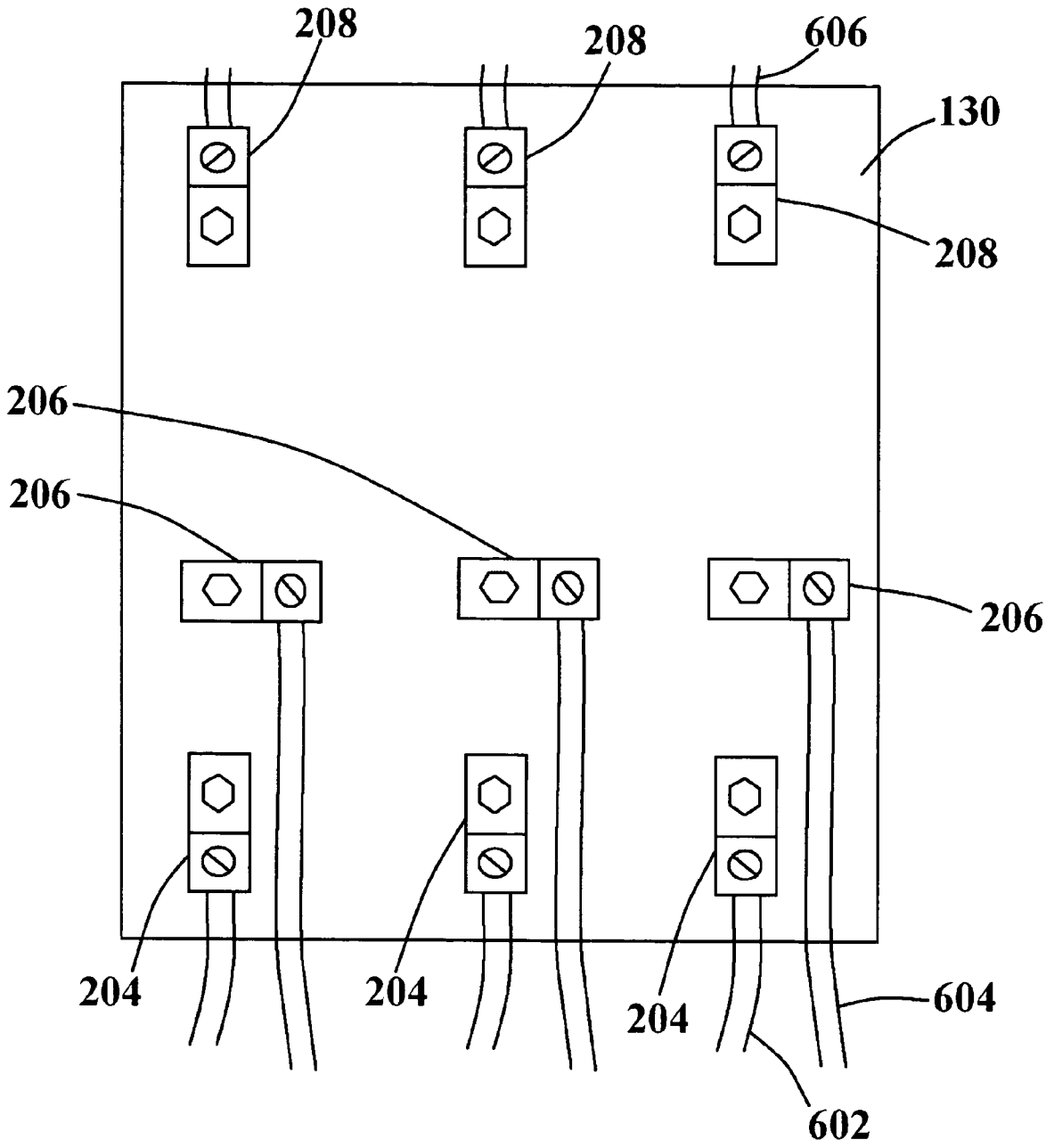
FIG. 6 is a bottom view of a switch showing a preferred positioning of electrical connections.

Turning to FIG. 6, the bottom side of the insulating board 130 is shown along with electrical connections for connecting the switch to a circuit. Board 130 is shown separate from the other components of the switch for simplicity of illustration. Connections 204, 206 and 208 are positioned in rows along the bottom of board 130. They are aligned with the contacts on the opposite face of the board. The middle row of connections 206 are oriented at a ninety degree rotation from the orientation of the lower connections 204. The top row of connections 208 are oriented at a ninety degree rotation from the orientation of the middle connections 206. This configuration permits wires 602 to pass into the outer end of connections 204. Because connections 206 are rotated, the connections they make are offset. This permits wires 604 to pass along the side of connections 204. Wires 606 pass into the outer end of connections 208. This configuration avoids overlap of the wires.

Figure 7:
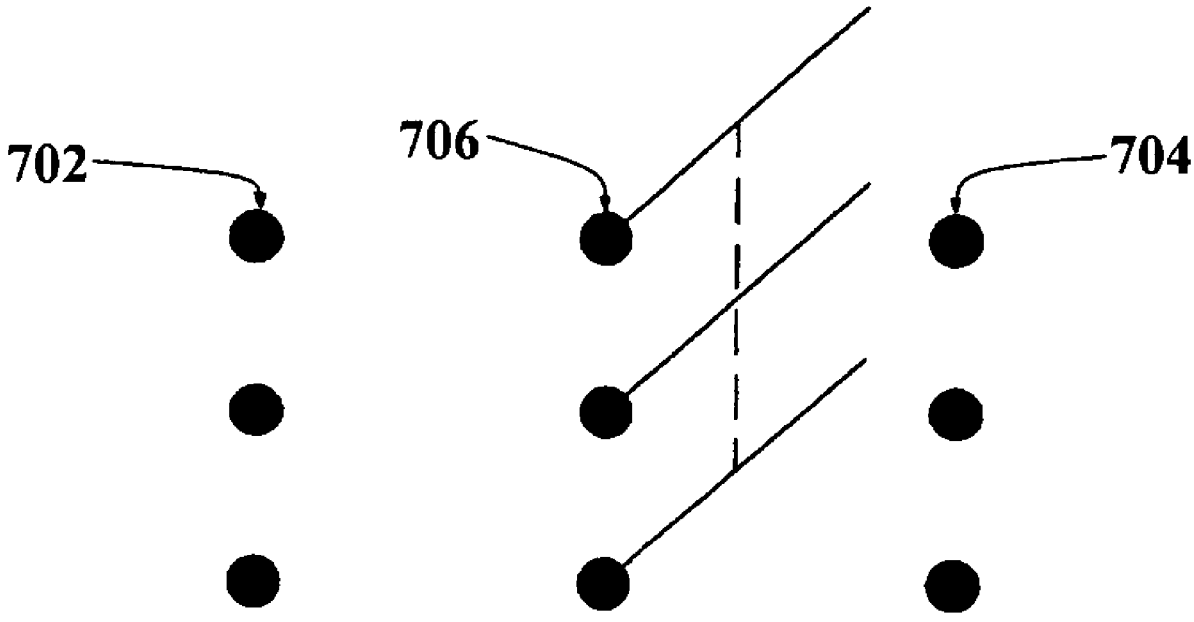
FIG. 7 is an electrical schematic drawing of the three-phase switch of FIG. 1A.

Turning to FIG. 7, an electrical schematic of the switch 100 is shown. It has a set of contacts 702 for connecting with a power source such as an electrical grid. It has a set of contacts 704 for connecting with an auxiliary power supply. And, it has a set of contacts 706 for connecting with a load.

Figure 8:
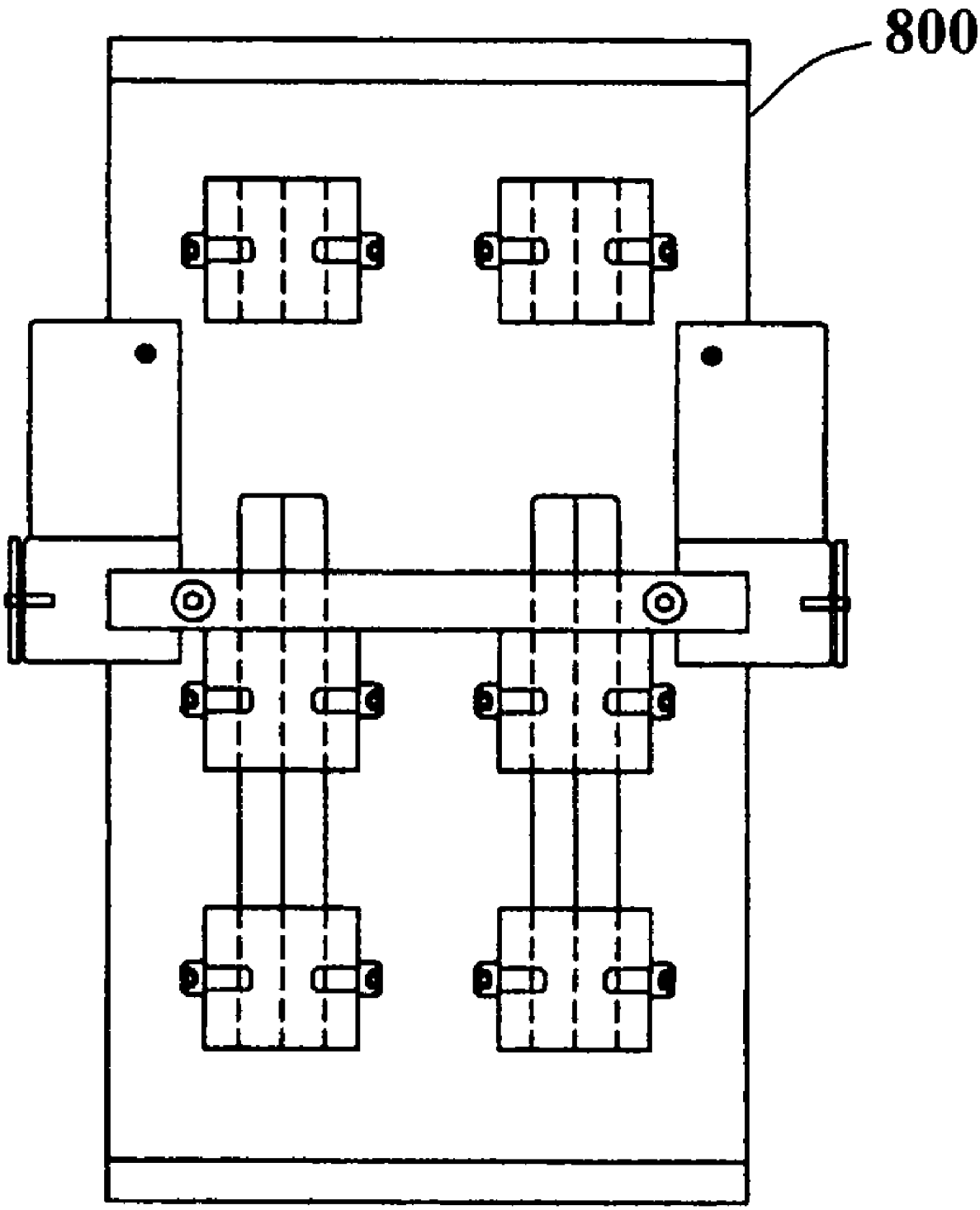
FIG. 8 is a top view of a two-phase switch.

Turning to FIG. 8, a two-phase switch 800 is shown. It has the same construction as the switch described in FIG. 1A above but with two sets of connections rather than three.

Figure 9:
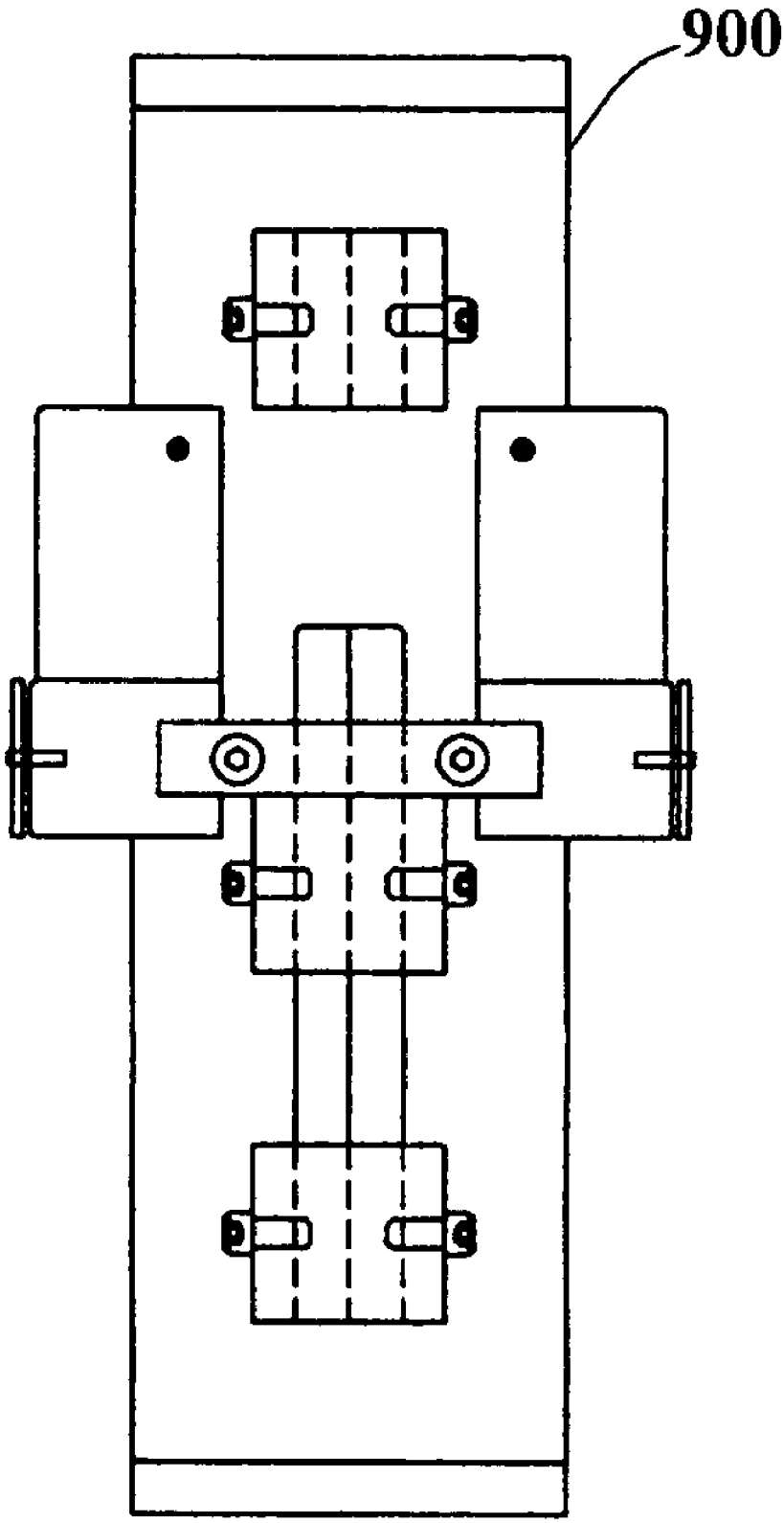
FIG. 9 is a top view of a one-phase switch.

Turning to FIG. 9, a one-phase switch 900 is shown. It has the same construction as the switch described in FIG. 1A above but with one set of connections rather than three.

Although the invention has been described with reference to specific preferred embodiments and with reference to specific applications, those skilled in the art will appreciate that many modifications and variations can be made without departing from the invention. All such variations and modifications are intended to be encompassed within the scope of the following claims.

The invention claimed is:

1. A switch especially suitable for connecting a load to one of two power supplies, the switch comprising:

a first set of connections for connecting with a first power supply;

a second set of connections for connecting with a second power supply;

a first and a second set of contacts, wherein each of the contacts has a first connection block defining a first surface channel extending from a first end to a second end of the first connection block and a second connection block defining a second surface channel extending from a first end to a second end of the second connection block wherein the first surface channel and the second surface channel are aligned to define an interior channel open at the first and second ends of the first and second connection blocks, wherein the first set of contacts is electrically coupled with the first set of connections and the second set of contacts is electrically coupled with the second set of connections;

a third set of connections for connecting to a load; and a set of plungers electrically coupled with the third set of connections, wherein the plungers have a first end and a second end, wherein the first ends of the plungers are configured to fit within and make electrical contact with the interior channels defined by the first set of contacts and the second ends of the plungers are configured to fit within and make electrical contact with the interior channels defined by the second set of contacts.

2. The switch of claim 1, wherein the first, second and third set of connections each comprise an interior channel for receiving an end of a wire and a screw for making physical and electrical connection with the end of the wire.

3. The switch of claim 2 further comprising an insulated board on which the first, second and third set of connections are mounted, wherein the first set of connections are positioned in a first row proximate a first end of the insulated board, the second set of connections are positioned in a second row proximate a second end of the insulated board and the third set of connections are positioned in a third row between the first end and the second end of the insulated board, wherein the second and third rows are parallel to the first row.

4. The switch of claim 2, wherein the first and third set of connections are evenly spaced and wherein the even spacing of the third set of connections is offset from the even spacing of the first set of connections so that wires connecting with the third set of connections are offset from the first set of connections and pass through the even spacing of the first set of connections.

5. The switch of claim 4, wherein the insulated board has a top and a bottom side and wherein the first and second set of contacts are positioned on the top side and the first, second and third set of connections are positioned on the bottom side.

6. The switch of claim 5, wherein the first and the second surface channels each define a v-shaped groove so that the interior channel defined by the first and the second connection block has a square cross section.

7. The switch of claim 6, wherein the set of plungers comprise a set of square rods positioned between the first and the second set of contacts to selectively engage the first and the second set of contacts and wherein the set of square rods are oriented that their side walls lie at an approximately forty five degree angle with respect to the top side of the insulated board.

8. The switch of claim 7 further comprising a third set of contacts positioned between the first and the second set of contacts, wherein the third set of contacts electrically connect the set of plungers with the third set of connections and wherein each of the third set of contacts has the same construction as the first and second set of contacts.

9. The switch of claim 8, further comprising:

an insulated bar through which the set of plungers pass, wherein the insulated bar has a top half and a bottom half between which the set of plungers are pinched to form a firm physical connection;

a handle operationally coupled with the insulated bar and configured to move the insulated bar from a first position to a second position wherein when the insulated bar is in the first position the set of plungers engage the first set of connections and wherein when the insulated bar is in the second position the set of plungers engage the second set of connections.

10. A three-phase switch especially suitable for selecting between two power sources comprising:

a housing;

a first set of connections for connecting with a first power source;

a first set of cylinders electrically connected with the first set of connections, wherein each of the cylinders have an electrically conductive inner wall;

a second set of connections for connecting with a second power source;

a second set of cylinders electrically connected with the second set of connections, wherein each of the cylinders have an electrically conductive inner wall;

a third set of connections for connecting with a load;

a set of pistons electrically connected with the third set of connections, wherein each of the pistons has an electrically conductive outer wall that is sized to fit within the inner walls of the first set of cylinders and the inner walls of the second set of cylinders, and wherein the set of pistons are switchable between a first and a second position, wherein the first position establishes an electrical connection between the first power source and the load by electrical contact between the electrically conductive outer walls of the set of pistons and the electrically conductive inner walls of the first set of cylinders and wherein the second position establishes an electrical connection between the second power source and the load by electrical contact between the electrically conductive outer walls of the set of pistons and the electrically conductive inner walls of the second set of cylinders.

* * * * *